United States Patent [19]

Ray et al.

[11] Patent Number: 5,074,994

[45] Date of Patent: Dec. 24, 1991

[54] SEQUENTIAL AND SELECTIVE FLOTATION OF SULFIDE ORES

[75] Inventors: Harold M. Ray, Potosi, Mo.; Nathaniel Arbiter, Vail, Ariz.

[73] Assignee: The Doe Run Company, St. Louis, Mo.

[21] Appl. No.: 599,620

[22] Filed: Oct. 18, 1990

[51] Int. Cl.[5] ..... B03D 1/002; B03D 1/016; B03D 1/06

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 3,220,551 | 11/1965 | Moyer | 209/167 |
| 4,283,017 | 8/1981 | Coale et al. | 241/24 |
| 4,339,331 | 7/1982 | Lim | 209/167 |
| 4,460,459 | 7/1984 | Shaw et al. | 209/9 |
| 4,549,959 | 10/1985 | Armstrong | 209/167 |
| 4,877,517 | 10/1989 | Bulatovie | 209/167 |

FOREIGN PATENT DOCUMENTS

| | | |
|---|---|---|
| 81527/75 | 12/1976 | Australia . |
| US88/02283 | 7/1988 | PCT Int'l Appl. . |

OTHER PUBLICATIONS

"The Broken Hill Concentrator of Black Mountain Mineral Development Co., South Africa", by Beck et al—Presented at Complex Sulfide Ore Conference—Rome, 1980.

"Flotation reagents", American Cyanamid Company, 1960.

*Mining Chemicals Handbook*, "Mineral Dressing Notes No. 26", American Cyanamid Company, 1986.

*Primary Examiner*—Stanley S. Silverman
*Assistant Examiner*—Thomas M. Lithgow
*Attorney, Agent, or Firm*—Armstrong, Teasdale, Schlafly & Davis

[57] ABSTRACT

A sequential flotation process for the separation of components of a sulfide ore selected from the group consisting of copper and lead sulfide containing ores and copper, zinc and lead sulfide containing ores in which the copper component is initially selectively floated directly from said ore by conditioning the ore with a combination of a source of bisulfite ion and causticized starch to produce a conditioned ore having a pH between approximately 5.7 and 6.5, and thereafter treating the conditioned ore with a collector selected from the group consisting of dialkyl dithiophosphates and alkyl dithiophosphinates.

26 Claims, 2 Drawing Sheets

SEQUENTIAL AND SELECTIVE FLOTATION OF SULFIDE ORES

BACKGROUND OF THE INVENTION

This invention relates to sequential flotation of sulfide ores and, more particularly, to the sequential and selective initial flotation of the copper component directly from ores containing copper sulfide and the sulfide of other metals such as lead and zinc.

Copper-lead and copper-lead-zinc ores of the type common to the lead belt areas of southeastern Missouri are complex ores and contain galena, sphalerite, pyrite and copper sulfides such as chalcopyrite or chalcocite in a siliceous carbonate matrix. The usual methods for treatment of copper-lead-zinc sulfide ores include the selective depression of zinc with cyanide and/or zinc sulfate, or a sulfite, followed by the selection flotation of a bulk copper-lead concentrate using xanthates, mercaptobenzothiazole or diaryl dithiophosphate collectors with known frothers. The zinc minerals remaining in the copper-lead tailings are then conditioned with a soluble copper solution, usually copper sulfate with lime added for pH control, and are floated with a zinc collector. The bulk copper-lead concentrate is further treated to separate the lead and copper sulfides.

One method for treating bulk copper-lead concentrates having a lead-copper ratio of about 5 to 1 involves contacting the concentrates with 1.5 to 2.0 lb./ton $SO_2$ in a tower with the discharge from the tower being conditioned for 20 minutes with 3 to 5 lb./ton sodium dichromate to depress lead. The pH is adjusted to about 5 with lime for copper flotation and selectivity is achieved through four to five cleaning stages in which cyanide is used. A second method is used in making a separation of copper and lead from bulk concentrates in which the lead to copper ratio is less than 2 to 1 with the copper mineral being a coarse, unaltered chalcopyrite. In this method, the separation is made with either straight cyanide or with a zinc-cyanide compound as a copper depressant. If straight cyanide is used, considerable loss of copper and gold values occurs through dissolution, but these losses are eliminated when the zinc-cyanide complex is used. In a third method employed for bulk copper-lead concentrates having a high lead to copper ratio, the concentrate is treated with sulphurous acid and boiled starch to depress lead and the pH is held at 6. Starch is also used in the roughers and cleaners. Alternatively, in this method, the bulk copper-lead concentrate is passed through an $SO_2$ tower with reagent consumption being about 4 lb./ton sulfur and 0.6 lb./ton corn starch.

In addition, one method is known for making a direct separation of copper, lead and zinc in the rougher flotation circuit from an ore consisting of sphalerite, galena, pyrite and chalcopyrite. In this method, copper is floated first after $SO_2$ has been added in the grinding circuit to depress zinc. Lead is next recovered with cyanide being added to depress zinc.

U.S. patents concerned with recovery of copper from complex ores by flotation include U.S. Pat. Nos. 3,220,551; 4,283,017 and 4,460,459.

There remains a need for improved methods for the direct flotation of copper from ores containing the sulfides of copper, lead, zinc and other minerals and, in particular, for effecting a primary selective flotation of copper by direct treatment of such ores rather than by the initial formation of a bulk copper-lead concentrate.

SUMMARY OF THE INVENTION

Among the objects of the present invention may be noted the provision of an improved flotation process for initially effecting selective flotation of the copper component of ores containing sulfides of copper and lead or of copper, zinc, lead and other minerals; the provision of such an improved process which permits advantageous economies in reagent use to be realized; the provision of an improved flotation process wherein the use of lime as a reagent is avoided; the provision of such a process which effects the selective and economical recovery of copper directly from a copper sulfide-containing ore; the provision of a process of the type described which affords flexibility and permits the use of existing equipment; and the provision of such a process which optimizes the recovery of copper, lead and zinc values from ores containing sulfides of these minerals. Other objects will be in part apparent and in part pointed out hereinafter.

Briefly, in its broadest aspect, the present invention is directed to an improvement in a sequential flotation process for the separation of components of a copper and lead sulfide containing ore or a copper, zinc and lead sulfide containing ore wherein the ore is routed sequentially through a series of flotation circuits having separation and concentration stages for separating and concentrating the components thereof, the improvement comprising initially effecting selective flotation of the copper component directly from the ore by conditioning the ore with a combination of a source of bisulfite ion and causticized starch to produce a conditioned ore having a pH between approximately 5.7 and 6.5, and thereafter treating the conditioned ore with an dialkyl dithiophosphate or alkyl dithiophosphinate collector.

In one embodiment of the invention, a process is provided for selectively and sequentially recovering a copper concentrate and a lead concentrate directly from an ore containing sulfides of copper and lead and being substantially free of water-soluble copper compounds which involves the steps of:

(a) grinding a mixture of the ore and water to produce a slurry;
(b) conditioning the slurry with a combination of a source of bisulfite ion and causticized starch to depress lead and promote copper flotation, the conditioned slurry having a pH between approximately 5.7 and 6.5:
(c) adding to the conditioned ore a frother and a collector selected from the group consisting of dialkyl dithiophosphates and alkyl dithiphosphinates;
(d) subjecting the conditioned slurry to froth flotation to produce a copper rougher concentrate and cleaning the copper rougher concentrate to produce a copper concentrate;
(e) conditioning the tailing from the froth flotation in step (d) with a lead collector and a frother to produce a lead rougher concentrate; and
(f) cleaning the lead rougher concentrate to produce a final lead concentrate.

In another embodiment of the invention, a process is provided for selectively and sequentially recovering a copper concentrate, a zinc concentrate and a lead concentrate directly from an ore containing sulfides of copper, zinc and lead and being substantially free of water-soluble copper compounds which involves the steps of:

(a) grinding a mixture of the ore and water to produce a slurry;

(b) conditioning the slurry with a combination of a source of bisulfite ion and causticized starch to depress zinc and lead and promote copper flotation, the conditioned slurry having a pH between approximately 5.7 and 6.5;

(c) adding to the conditioned slurry a frother and a collector selected from the group consisting of dialkyl dithiophosphates and alkyl dithiophosphinates;

(d) subjecting the conditioned slurry to froth flotation to produce a copper rougher concentrate and cleaning the copper rougher concentrate to produce a copper concentrate;

(e) treating the tailing from the froth flotation in step (d) with a zinc activator, a zinc collector and a frother to produce a zinc rougher concentrate and cleaning the zinc rougher concentrate to produce a zinc concentrate;

(f) conditioning the tailing from the froth flotation in step (e) with a lead collector and a frother to produce a lead rougher concentrate; and (g) cleaning the lead rougher concentrate to produce a final lead concentrate.

DESCRIPTION OF THE PREFERRED EMBODIMENTS

Figure 1:
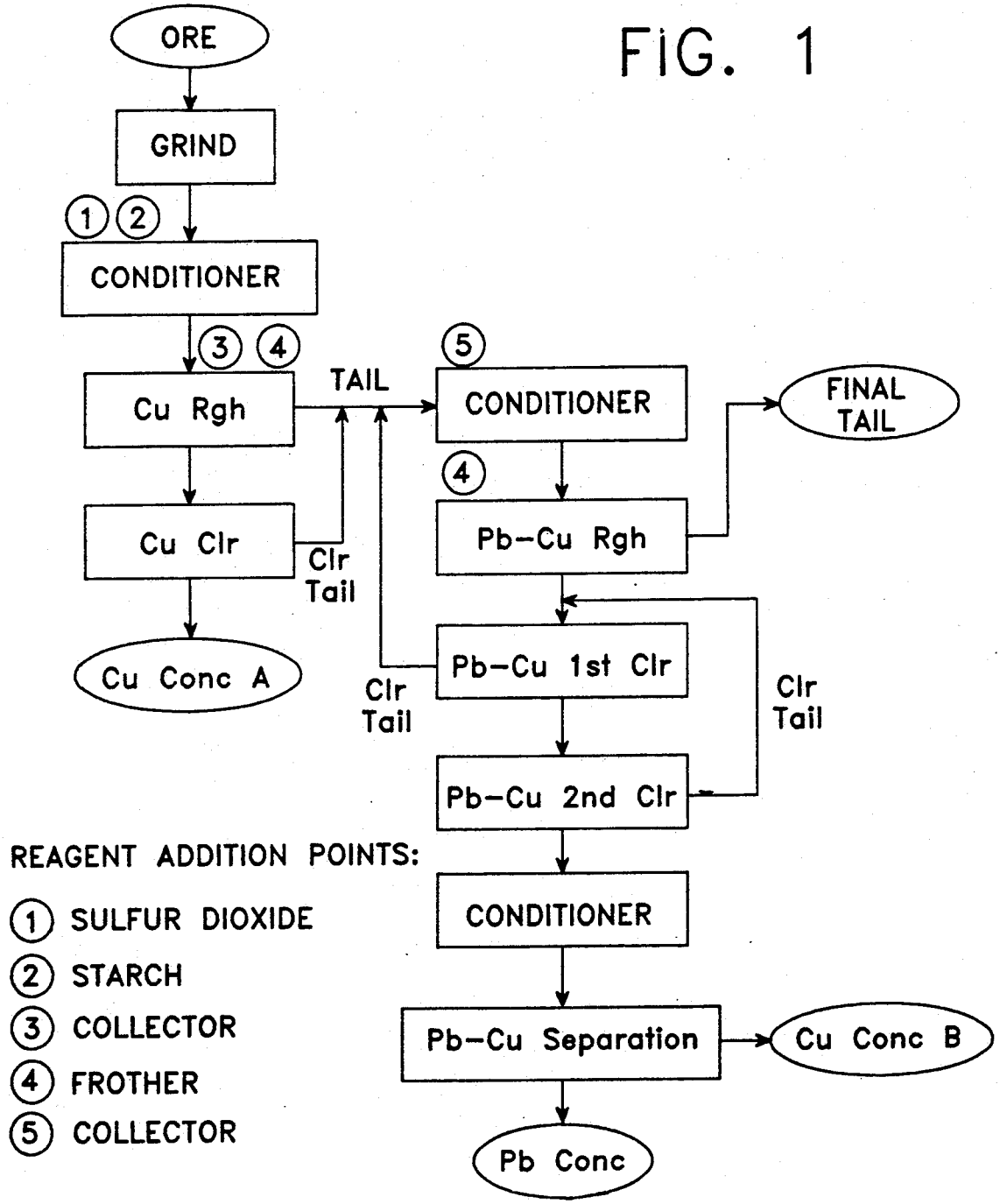
FIG. 1 is a flowsheet of a selective and sequential flotation process according to the present invention.

In accordance with the present invention, it has now been found that the copper component of copper and lead sulfide containing ores or copper, zinc and lead sulfide containing ores may be directly separated from such ores through selective flotation by conditioning the ore with a combination of a source of a bisulfite ion and causticized starch to produce a conditioned ore having a pH between approximately 5.7 and 6.5, and thereafter treating the conditioned ore with an dialkyl dithiophosphate or alkyl dithiophosphinate collector. With the use of these conditions, the present invention avoids the necessity for first effecting a primary flotation of a bulk copper/lead concentrate and permits selective flotation between copper and lead directly where the copper minerals occur as chalcopyrite, bornite, or chalcocite, and the lead as galena; and also among copper, lead and zinc, where the zinc occurs as sphalerite and/or marmatite. Moreover, through the use of such optimum conditions, the present invention achieves maximum selectivity, avoids the use of lime, permits economies in reagent usage and attains effective pyrite depression as well as galena depression. Further, in contrast to existing processes which first effect a primary flotation of a bulk copper/lead concentrate and leave unacceptable levels of the copper in the final lead concentrate (e.g. more than 1% copper in the lead concentrate), the present invention selectively removes an adequate or sufficient amount of copper in the initial selective copper flotation so that the final lead concentrate will be characterized by a low copper content, the bulk concentrate or tailing from the initial selective copper flotation having a lead/copper ratio of greater that 5/1. The invention is particularly applicable to copper and lead sulfide containing ores for Southeastern Missouri which contain more that 1% lead and less than 3% copper and enables the production of copper concentrates containing more than 25% copper.

The selective initial flotation of copper directly from copper and lead sulfide containing ores or copper, zinc and lead sulfide containing ores is carried out at a pH between approximately 5.7 and 6.5, this range preferably being between 5.8 and 6.3 in the case of copper and lead sulfide containing ores and between 5.7 and 6.5 in the case of copper, zinc and lead sulfide containing ores. The optimal pH range in the case of copper and lead sulfide containing ores is between approximately 6.0 and 6.2 and the optimal pH range in the case of copper, zinc and lead sulfide containing ores is between approximately 6.0 and 6.2. These pH values are achieved by conditioning a slurry of the copper ore and water with a combination of a source of a bisulfite ion and causticized starch. It is believed that the concentration of the bisulfite ion is important to the selective flotation according to the present invention, and the inventors believe that the pH is an indicator of bisulfite ion concentration. A preferred source of bisulfite ion is sulfur dioxide, but other sources of bisulfite ion such as sulfurous acid and alkali metal salts of sulfites, bisulfites and meta bisulfites may also be employed. Typically, between approximately 2 and 5 pounds per ton of ore of sulfur dioxide in the form of a 2.5% sulfur dioxide solution may be utilized in the practice of invention as a convenient source of bisulfite ion. Of course, other sources of bisulfite ion may be used, for example liquid or gaseous $SO_2$. The causticized starch for use in the invention may be prepared by dispersing 25 grams of starch, such as that marketed under the trade designation "Stazyme JT" by A. E. Staley Manufacturing Company, in 1000 ml. of water and then adding 5 grams of sodium hydroxide beads to produce a 2.5% strength solution of causticized starch. Other alkali metal hydroxides may also be employed in the preparation of the causticized starch reagent. In actual practice in the mill, the strengths of the solutions used in the practice of the invention may be greater.

After the ore has been conditioned with a combination of a source of bisulfite ion and causticized starch and the proper pH value has been achieved as described, the conditioned ore is treated with either a dialkyl dithiophosphate collector or, less preferably, with an alkyl dithiophosphinate collector. The preferred collector for use in the invention is a mixture or blend of diisobutyl, diisoamyl and di n-pentyl dithiophosphates such as that marketed by The Lubrizol Corporation under the trade designation "Flotezol 150". Also useful as a collector is a blend of diisobutyl, diisoamyl and diamyl dithiphosphates such as that marketed under the trade designation "S6865" by American Cyanamid Co. or a blend of diisobutyl and diisoamyl dithiophosphates. A useful alkyl dithiophosphinate is that marketed under the trade designation "3418A" by American Cyanamid Co.

Thus, the use of the above-described conditions has been found to maximize and optimize the selective flotation of the copper component directly from ores containing copper and lead sulfides, and the present invention provides significant advantages in the selective flotation of copper from ores having a relatively high copper content and a relatively low lead content.

FIG. 1 is a flowsheet showing the detailed practice of the invention as applied to ores containing sulfides of copper and lead such as a Missouri lead ore containing significant amounts of copper. As shown, a mixture of the ore and water is first ground to produce a slurry. The resulting slurry is then conditioned with a combination of a source of bisulfite ion, such as $SO_2$, and causticized starch to produce a conditioned ore having a pH between approximately 5.7 and 6.5, preferably between 6.0 and 6.2. The conditioned ore is then treated with one of the above-noted collectors and a frother to effect flotation of a copper rougher concentrate. Various frothers known to the art, such as methyl isobutyl carbinol and polyglycol ethers, may be used. The copper rougher concentrate is then cleaned by conditioning it with causticized starch and flotation of copper concentrate A is effected with a frother which may, for example, be constituted by a mixture of methyl isobutyl carbinol and polyglycol ether.

The tailing from the copper rougher flotation stage is conditioned with a lead collector, such as an alkyl dithiophosphinate or xanthate or other known lead collectors, and a frother to produce a lead rougher concentrate. To olean the latter concentrate, zinc cyanide is added to enhance depression of pyrite and the resulting concentrate is floated. Usually two such cleaning steps will be carried out with the second being a duplicate of the first to obtain a bulk cleaner concentrate which is then forwarded to a copper-lead separation circuit. From this circuit, a lead concentrate and copper concentrate B are obtained. As shown by the test results set forth hereinafter, the present invention permits the recovery of more than 90% of the copper in the ore by selective flotation of the copper component directly from the ore under the conditions described.

In applying the improved process of the invention to ores containing sulfides of copper, zinc and lead, the same procedure described above is carried out to effect selective initial flotation of copper from the ore with zinc sulfate being added to the initial slurry in order to enhance the depression of zinc by the combination of the source of bisulfite ion and causticized starch. Also, the pH of the initial conditioned slurry is preferably between approximately 6.0 and 6.3. The tailing from the copper rougher flotation stage is then conditioned with additional $SO_2$ or other source of bisulfite ion and causticized starch and also with a zinc activator such as copper sulfate or other soluble copper compound. The thus conditioned material is further conditioned with a zinc collector such as the blends of dialkyl dithiophosphates described above and then subjected to froth flotation with a frother to produce a zinc rougher concentrate. This zinc rougher concentrate is then subjected to two cleaning steps by conditioning the rougher concentrate with starch and a frother to produce a zinc concentrate. The tailing from the zinc rougher flotation stage is then treated as previously described to produce a lead concentrate and a second copper concentrate.

The following examples illustrate the practice of the invention.

EXAMPLE 1

A 1000 gram ore sample with 500 cc of water (approximately 67% solids) was ground for eight minutes in a Denver Equipment Co. laboratory rod/ball mill charged with rods. This resulted in a screen distribution of 85 to 90% minus 200 mesh. After washing the ground material from the mill, the slurry was conditioned in a Denver Equipment Co. 500 gram stainless steel cell at 1350 rpm and about 30 to 40% solids. Conditioning was carried out with a 2.5% strength sulfur dioxide solution (75 to 120 cc) and causticized starch (5 to 20 cc) for four minutes. The causticized starch was prepared by first dispersing 25 grams starch in 500 cc of dilution water and then adding 5 grams of sodium hydroxide beads. The solution was stirred until it changed from a milky white to a translucent liquid. A final 500 cc of water was added to produce a 2.5% strength causticized starch solution.

The initial pH of the slurry typically ranges from 7.3 to 7.9. Between about 2 to 5 pounds $SO_2$ per ton of ore are required to achieve a conditioned slurry with a pH between approximately 5.7 and 6.3, with the causticized starch additions usually being about 0.25 pound starch per ton of ore or within the range of approximately 0.25 to 1.00 pound per ton of ore (5 to 20 cc).

Following the conditioning stage, a collector consisting of a blend of diisobutyl, diisoamyl and diamyl dithiophosphates (e.g. the "S6865" reagent, typically 3 to 5 syringe drops with each drop weighing about 0.0057 grams) was added together with the frother methyl isobutyl carbinol (typically 3 to 5 drops with each drop weighing about 0.015 grams) to produce a recoverable froth. After a period of about one minute to provide adequate time for reagent dispersion, a copper rougher concentrate was recovered for 3 to 5 minutes. The recovery time is dependent on the copper content of the ore with higher concentrations usually requiring longer periods.

To clean the copper rougher concentrate, the froth product was transferred to a 250 gram cell and conditioned with a frother (typically 1 to 3 drops of a 3:1 mixture of methyl isobutyl carbinol and a polyglycol ether) at about 1100 rpm for 1 minute following which the copper cleaner concentrate froth was collected for 2 to 4 minutes to produce copper concentrate A as shown in FIG. 1. Normally no special depressants are needed as the primary gangue mineral, dolomite, is readily removed by the cleaning steps.

The tailing from the copper rougher flotation stage still in the 500 gram cell was conditioned for one minute with an alkyl dithiophosphinate collector (e.g., the "3418A" reagent) (typically 3 to 5 syringe drops with each drop weighing about 0.008 grams) or another suitable lead collector and with 1 to 3 drops of the frother methyl isobutyl carbinol. The concentrate froth was then collected for 2 to 4 minutes. Depending upon the copper recovery in the copper flotation, the product may be treated as a bulk concentrate or as a lead rougher concentrate. If the copper recovery is less than about 90%, the product is usually treated as a bulk concentrate and subjected to further separation steps to recover additional copper and produce a lead rougher concentrate. Table I, below, reflects a process where the flotation of the tailing from the copper rougher float would produce a lead-copper or "bulk" concentrate that would typically be subjected to further separation steps to recover additional copper. Table II, below, reflects a process where the flotation of the tailing from the copper rougher float would produce a lead rougher concentrate and typically would not be subjected to additional copper recovery steps.

To clean the lead copper rougher concentrate, the froth product was transferred to a 250 gram cell, diluted to volume, conditioned for one minute with zinc cyanide (8%) to enhance depression of pyrite and chalcopyrite and then floated for 2 to 4 minutes. The resulting material was subjected to two cleaning steps to reduce the gangue content with the second cleaning stage being a duplicate of the first. While the gangue is primarily dolomite, some minor amounts of pyrite and chalcopyrite present in the lead rougher concentrate are more readily depressed with the addition of zinc cyanide at a pH approaching 7.0. At lower pH values only the pyrite is depressed.

The resulting bulk lead copper concentrate was then forwarded to a copper-lead separation circuit, and from this circuit a lead concentrate and copper concentrate B were produced.

The following Table I sets forth the results obtained from various runs employing the above-described procedures:

TABLE I

| | ORE GRADE | | | | CU CONC A | | | | CU CONC B | | | |
|---|---|---|---|---|---|---|---|---|---|---|---|---|
| Run | % PB | % ZN | % Cu | % FE | % PB | % ZN | % Cu | % Fe | % Pb | % ZN | % Cu | % Fe |
| 1 | 1.40 | 0.14 | 2.72 | 3.97 | 1.62 | 0.10 | 28.95 | 27.90 | 2.06 | 0.75 | 25.03 | 26.30 |
| 2 | 1.65 | 0.27 | 2.60 | 4.01 | 1.88 | 0.16 | 30.03 | 28.17 | 4.78 | 2.69 | 26.07 | 26.39 |
| 3 | 1.05 | 0.04 | 2.25 | 4.24 | 1.95 | 0.07 | 28.69 | 28.25 | 2.09 | 3.19 | 18.74 | 25.76 |
| 4 | 1.21 | 0.02 | 2.77 | 4.48 | 1.54 | 0.04 | 28.67 | 28.42 | 4.64 | 0.63 | 18.52 | 24.53 |
| 5 | 1.22 | 0.07 | 2.70 | 4.00 | 3.47 | 0.10 | 29.03 | 27.76 | 4.64 | 1.55 | 18.88 | 24.25 |
| 6 | 1.48 | 0.05 | 1.75 | 3.12 | 3.06 | 0.05 | 29.85 | 27.76 | 8.04 | 3.04 | 15.94 | 22.01 |
| 7 | 2.12 | 0.07 | 2.69 | 4.05 | 4.78 | 0.10 | 28.67 | 26.74 | 9.19 | 2.70 | 13.21 | 21.01 |
| 8 | 1.05 | 0.07 | 2.67 | 4.38 | 1.27 | 0.16 | 30.72 | 28.73 | 1.98 | 1.75 | 21.42 | 25.89 |
| 9 | 0.93 | 0.08 | 1.94 | 3.82 | 2.79 | 0.28 | 26.87 | 27.20 | 2.28 | 3.30 | 18.28 | 24.97 |
| 10 | 1.16 | 0.06 | 2.00 | 4.06 | 1.99 | 0.18 | 28.63 | 28.40 | 6.47 | 1.74 | 18.01 | 24.37 |
| 11 | 0.59 | 0.03 | 2.90 | 5.01 | 1.45 | 0.10 | 31.42 | 28.91 | 2.13 | 1.13 | 26.61 | 27.40 |
| 12 | 0.89 | 0.06 | 3.87 | 5.87 | 1.11 | 0.10 | 31.43 | 28.78 | 2.65 | 2.16 | 23.47 | 25.56 |
| 13 | 1.08 | 0.30 | 2.75 | 4.87 | 1.27 | 0.13 | 31.66 | 29.16 | 4.35 | 8.04 | 21.96 | 24.86 |

| | WTED AVG CU A & B | | | | PB CONC | | | | FINAL TAIL | | | | % REC IN CONC | |
|---|---|---|---|---|---|---|---|---|---|---|---|---|---|---|
| | % Pb | % Zn | % Cu | % Fe | % Pb | % Zn | % Cu | % Fe | % Pb | % Zn | % Cu | % Fe | Cu in A & B | Pb in PB CONC |
| 1 | 1.73 | 0.26 | 27.97 | 27.50 | 74.35 | 3.66 | 1.53 | 1.77 | 0.32 | 0.03 | 0.20 | 1.62 | 92.68 | 68.35 |
| 2 | 2.61 | 0.79 | 29.04 | 27.73 | 81.69 | 0.24 | 1.05 | 1.16 | 0.47 | 0.19 | 0.38 | 1.94 | 86.19 | 61.86 |
| 3 | 1.98 | 0.85 | 26.20 | 27.63 | 70.12 | 5.31 | 1.83 | 2.28 | 0.21 | 0.02 | 0.16 | 2.05 | 92.71 | 66.78 |
| 4 | 2.32 | 0.19 | 26.13 | 27.45 | 71.99 | 2.27 | 2.57 | 3.09 | 0.24 | 0.03 | 0.23 | 1.96 | 91.60 | 63.68 |
| 5 | 3.76 | 0.46 | 26.49 | 26.88 | 71.01 | 3.78 | 2.04 | 2.52 | 0.17 | 0.05 | 0.25 | 1.76 | 90.93 | 58.90 |
| 6 | 4.31 | 0.80 | 26.37 | 26.32 | 74.64 | 4.23 | 0.68 | 0.93 | 0.19 | 0.01 | 0.20 | 1.60 | 88.88 | 70.92 |
| 7 | 5.88 | 0.75 | 24.81 | 25.31 | 73.65 | 3.17 | 1.39 | 1.75 | 0.25 | 0.03 | 0.15 | 1.69 | 94.18 | 61.30 |
| 8 | 1.45 | 0.56 | 28.40 | 28.02 | 68.68 | 2.26 | 3.22 | 3.86 | 0.17 | 0.02 | 0.19 | 1.97 | 92.23 | 73.42 |
| 9 | 2.66 | 1.04 | 24.72 | 26.64 | 79.24 | 0.60 | 1.64 | 1.86 | 0.11 | 0.02 | 0.17 | 1.94 | 91.25 | 68.63 |
| 10 | 3.11 | 0.57 | 25.98 | 27.39 | 82.44 | 0.53 | 0.66 | 0.86 | 0.16 | 0.03 | 0.20 | 2.22 | 90.47 | 68.63 |
| 11 | 1.82 | 0.36 | 30.22 | 28.53 | 76.99 | 0.38 | 1.95 | 2.33 | 0.15 | 0.02 | 0.37 | 2.11 | 88.10 | 53.62 |
| 12 | 1.50 | 0.62 | 28.44 | 27.98 | 63.77 | 1.71 | 3.99 | 4.80 | 0.11 | 0.03 | 0.36 | 2.05 | 90.90 | 69.10 |
| 13 | 2.04 | 2.11 | 29.24 | 28.09 | 80.42 | 0.52 | 0.86 | 1.19 | 0.18 | 0.21 | 0.23 | 2.03 | 92.15 | 68.56 |

EXAMPLE 2

Example 1 was repeated using varying amounts of $SO_2$, causticized starch, the "S-6865" collector and various pH values.

The results obtained are set forth in the following Table II:

TABLE II

| | $SO_2$ | STARCH | DITHIO | | ORE GRADE | | | | CU RGH CONC | | | | Pb RGH CONC | |
|---|---|---|---|---|---|---|---|---|---|---|---|---|---|---|
| Run | LB/T | LB/T | LB/T | pH | % Pb | % Zn | % Cu | % Fe | % Pb | % Zn | % Cu | % Fe | % Pb | % Zn |
| 1 | 4.35 | 0.22 | 0.039 | 5.8 | 0.51 | 0.19 | 2.65 | 4.63 | 1.36 | 0.08 | 23.40 | 24.20 | 8.28 | 4.00 |
| 2 | 4.35 | 0.22 | 0.049 | 5.8 | 0.52 | 0.19 | 2.49 | 4.69 | 1.48 | 0.10 | 23.30 | 25.70 | 10.24 | 2.90 |
| 3 | 4.35 | 0.22 | 0.059 | 5.8 | 0.54 | 0.20 | 2.47 | 4.54 | 2.28 | 0.42 | 23.40 | 25.00 | 11.08 | 5.90 |
| 4 | 3.26 | 0.22 | 0.049 | 6.0 | 0.52 | 0.20 | 2.52 | 4.67 | 0.99 | 0.10 | 23.10 | 25.60 | 11.92 | 6.10 |
| 5 | 3.26 | 0.22 | 0.049 | 6.0 | 0.51 | 0.19 | 2.46 | 4.69 | 0.90 | 0.11 | 22.50 | 25.20 | 12.48 | 5.30 |
| 6 | 3.75 | 0.25 | 0.034 | 5.9 | 1.05 | 0.10 | 0.81 | 2.16 | 1.70 | 0.29 | 20.60 | 20.50 | 38.90 | 3.56 |
| 7 | 3.75 | 0.25 | 0.045 | 6.0 | 1.29 | 0.12 | 0.86 | 2.73 | 2.10 | 0.38 | 20.80 | 20.50 | 42.80 | 3.67 |
| 8 | 3.75 | 0.25 | 0.045 | 6.0 | 1.33 | 0.12 | 0.86 | 2.74 | 1.50 | 0.22 | 19.40 | 19.40 | 43.00 | 3.10 |
| 9 | 3.75 | 0.25 | 0.045 | 6.0 | 1.31 | 0.12 | 0.85 | 2.75 | 1.80 | 0.31 | 15.20 | 15.80 | 45.00 | 3.62 |
| 10 | 3.75 | 0.25 | 0.057 | 6.0 | 1.09 | 0.12 | 0.83 | 2.76 | 2.90 | 0.71 | 22.10 | 22.60 | 35.40 | 3.58 |

| | PERCENT REC IN RGH CONCS | | | | | | | | | |
|---|---|---|---|---|---|---|---|---|---|---|
| | Pb RGH CONC | | CU RGH CONC | | | | Pb RGH CONC | | | |
| Run | % Cu | % Fe | % Pb | % Zn | % Cu | % Fe | % Pb | % Zn | % Cu | % Fe |
| 1 | 13.00 | 15.50 | 22.40 | 3.62 | 74.69 | 44.19 | 69.10 | 91.71 | 21.03 | 14.34 |
| 2 | 7.90 | 10.10 | 25.98 | 4.78 | 85.47 | 50.05 | 63.92 | 49.34 | 10.31 | 7.00 |
| 3 | 4.70 | 10.30 | 41.37 | 20.60 | 92.02 | 53.65 | 52.09 | 74.98 | 4.79 | 5.73 |
| 4 | 5.70 | 8.40 | 18.53 | 4.88 | 89.77 | 53.56 | 68.10 | 90.77 | 6.76 | 5.36 |
| 5 | 3.90 | 5.90 | 17.53 | 5.69 | 90.86 | 53.45 | 75.65 | 85.27 | 4.90 | 3.89 |
| 6 | 2.40 | 6.90 | 5.62 | 9.74 | 88.35 | 26.66 | 87.19 | 81.11 | 6.98 | 6.09 |
| 7 | 1.20 | 3.10 | 6.23 | 11.99 | 91.99 | 28.60 | 87.96 | 80.27 | 3.68 | 3.00 |
| 8 | 1.70 | 3.60 | 4.53 | 7.18 | 90.20 | 28.36 | 89.96 | 70.05 | 5.47 | 3.64 |
| 9 | 1.20 | 3.20 | 7.15 | 13.65 | 93.13 | 29.94 | 87.94 | 78.54 | 3.62 | 2.99 |
| 10 | 1.10 | 7.30 | 9.25 | 20.26 | 92.09 | 28.44 | 83.85 | 75.88 | 3.40 | 6.82 |

EXAMPLE 3

Figure 2:
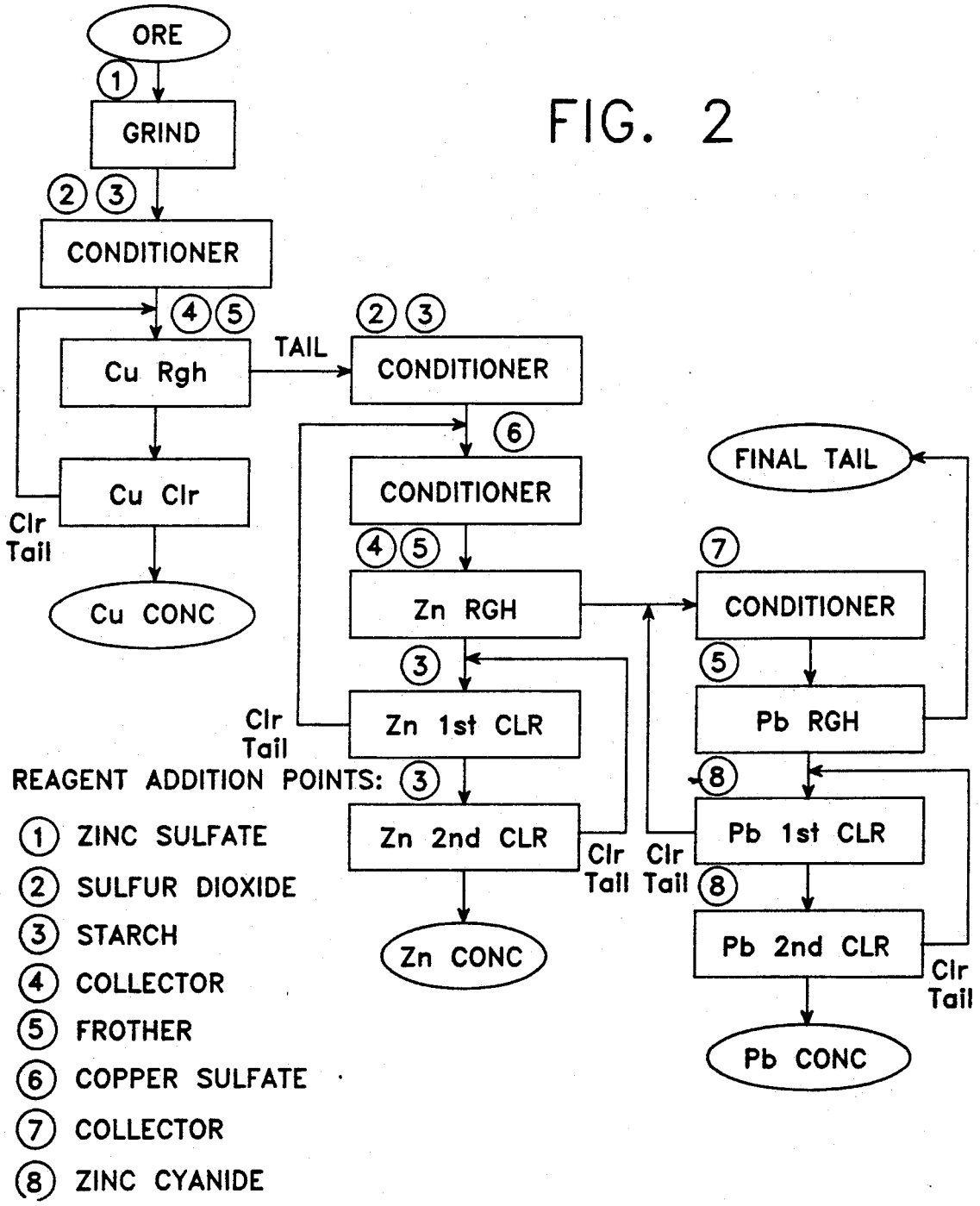
FIG. 2 is a flowsheet of a second example of a selective and sequential flotation process according to the present invention.

This example is illustrated in FIG. 2.

A 1000 gram ore sample containing copper, zinc and lead sulfides was ground for 8 minutes with 1.0 lb./ton of ore of zinc sulfate (12.5% $ZnSO_4.7H_2O$) and 500 cc of water. The resulting slurry had a pH of 7.2 and was conditioned in a 500 gram cell at 1350 rpm for 4 minutes with 3.75 lb/ton of $SO_2$ (2.5%) and 0.35 lb/ton of causticized starch. The zinc sulfate enhances the depressing effect of $SO_2$ and causticized starch on zinc. The conditioned slurry had a pH of 5.7, and was treated for one minute with 0.057 lb/ton of the collector "Flotezol 150" (The Lubrizol Corporation, a blend of diisobutyl, diisoamyl and di n-pentyl dithiophosphates) after which a copper rougher concentrate was floated for 3 minutes using 0.145 lb/ton of the frother methyl isobutyl carbinol. To clean the copper rougher concentrate, the froth product was conditioned for 1 minute with 0.05 lb/ton causticized starch and flotation was carried out for three minutes with 0.116 lb/ton of a 3:1 mixture of methyl isobutyl carbinol and a polyglycol ether to produce a copper concentrate.

The tailing from the copper rougher concentrate having a pH of 5.8 was conditioned for 1 minute with 0.5 lb/ton of $SO_2$ and 0.1 lb/ton of causticized starch to produce a conditioned material having a pH of 5.9. The conditioned material was further conditioned for 3 minutes with 0.075 lb/ton of a zinc activator, copper sulfate ($CuSO_4.5\ H_2O$, 1.25%) to yield a conditioned material having a pH of 5.9. This material was then conditioned for 1 minute with 0.011 lb/ton of the collector Flotezol 150 (marketed by The Lubrizol Corporation) and a zinc rougher concentrate was floated for 3 minutes with 0.058 lb/ton of methyl isobutyl carbinol. The zinc rougher concentrate was subjected to two cleaning steps, first by conditioning for 1 minute with 0.025 lb/ton of causticized starch followed by flotation for 3 minutes with 0.058 lb/ton of methyl isobutyl carbinol and then by conditioning for 1 minute with 0.025 lb/ton causticized starch followed by flotation for 2 minutes with 0.058 lb/ton of methyl isobutyl carbinol. This produced a zinc concentrate.

The tailing from the zinc rougher concentrate having a pH of 6.7 was conditioned for 1 minute with 0.067 lb/ton of an alkyl dithiophosphinate collector e.g., the "3418A" reagent) followed by flotation of a lead rougher concentrate for 3 minutes with 0.058 lb/ton of methyl isobutyl carbinol. The lead rougher concentrate was subjected to two cleaning steps, first by conditioning for 1 minute with 0.16 lb/ton of zinc cyanide (8%) followed by flotation for 3 minutes with 0.058 lb/ton of methyl isobutyl carbinol and then by conditioning for 1 minutes with 0.16 lb/ton of zinc cyanide followed by flotation for 2 minutes with 0.029 lb/ton of methyl isobutyl carbinol. This produced a final lead concentrate.

The results of the above described procedures are set forth in Table III.

TABLE III

| PRODUCT | WEIGHT GRAMS | % | ANALYSIS % Pb | Zn | Cu | Fe | % DISTRIBUTION Pb | Zn | Cu | Fe |
|---|---|---|---|---|---|---|---|---|---|---|
| Cu conc | 43.80 | 4.4 | 1.70 | 0.40 | 26.70 | 25.70 | 4.33 | 4.08 | 83.05 | 30.36 |
| Cu 1st cir tail | 23.20 | 2.3 | 3.83 | 0.96 | 5.00 | 8.20 | 5.17 | 5.18 | 8.24 | 5.13 |
| Zn conc | 7.50 | 0.8 | 8.50 | 48.10 | 1.51 | 3.10 | 3.71 | 83.94 | 0.80 | 0.63 |
| Zn 2nd cir tail | 5.90 | 0.6 | 28.00 | 1.72 | 3.60 | 9.70 | 9.61 | 2.36 | 1.51 | 1.54 |
| Zn 1st cir tail | 15.50 | 1.6 | 5.70 | 0.36 | 1.56 | 5.60 | 5.14 | 1.30 | 1.72 | 2.34 |
| Pb conc | 13.70 | 1.4 | 80.60 | 0.03 | 0.230 | 0.92 | 64.25 | 0.10 | 0.22 | 0.34 |
| Pb 2nd cir tail | 2.5 | 0.3 | 5.3 | 0.4 | 1.75 | 9.80 | 0.77 | 0.23 | 0.31 | 0.66 |
| Pb 1st cir tail | 20.2 | 2.0 | 1.26 | 0.17 | 0.75 | 18.40 | 1.48 | 0.80 | 1.08 | 10.02 |
| Tail | 864.8 | 86.7 | 0.11 | 0.01 | 0.05 | 2.10 | 5.53 | 2.01 | 3.07 | 48.98 |
| CALCULATED HEAD | 997.10 | 100.0 | 1.72 | 0.43 | 1.41 | 3.72 | 100.00 | 100.00 | 100.00 | 100.00 |

In view of the above, it will be seen that the several objects of the invention are achieved and other advantageous results attained.

As various changes could be made in the above methods without departing from the scope of the invention, it is intended that all matter contained in the above description shall be interpreted as illustrative and not in a limiting sense.

What is claimed is:

1. In a sequential flotation process for the separation of components of a sulfide ore selected from the group consisting of copper and lead sulfide containing ores and copper, zinc and lead sulfide containing ores wherein said ore is routed sequentially through a series of flotation circuits having separation and concentration stages for separating and concentrating the components thereof, the improvement comprising: initially effecting selective flotation of the copper component directly from said ore by conditioning the ore with a combination of a source of bisulfite ion and causticized starch to produce a conditioned ore having a pH between approximately 5.7 and 6.5 to depress lead and zinc and promote the copper, and thereafter treating the conditioned ore with a copper collector selected from the group consisting of alkyl dithiophosphinates and dialkyl dithiophosphates and subjecting the treated, conditioned are to said selective flotation to yield concentrate of said copper component and a tailing of said depressed lead and zinc components.

2. A process as set forth in claim 1 wherein said ore is a copper and lead sulfide containing ore and said pH is between approximately 5.8 and 6.3.

3. A process as set forth in claim 2 wherein said pH is between approximately 6.0 and 6.2.

4. A process as set forth in claim 1 wherein said collector is a blend of diisobutyl, diisoamyl and di n-pentyl dithiophosphates.

5. A process as set forth in claim 1 wherein said source of bisulfite ion is sulfur dioxide present in an amount between approximately 2 and 5 pounds per ton of ore.

6. A process as set forth in claim wherein said causticized starch is present in an amount between approximately 0.25 and 1.00 pound per ton of ore.

7. A process as set forth in claim 1 wherein said ore is a copper, zinc and lead sulfide containing ore and said pH is between approximately 5.8 and 6.3.

8. A process as set forth in claim 7 wherein said pH is between approximately 6.0 and 6.3.

9. A process for selectively and sequentially recovering a copper concentrate and a lead concentrate directly from an ore containing sulfides of copper and lead and being substantially free of water-soluble copper compounds which comprises the steps of:

(a) grinding a mixture of said ore and water to produce a slurry;

(b) conditioning said slurry with a combination of a source of bisulfite ion and causticized starch to depress lead and promote copper flotation, said conditioned slurry having a pH between approximately 5.8 and 6.3;

(c) adding to the conditioned ore a frother and a copper collector selected from the group consisting of alkyl dithiophosphinates and dialkyl dithiophosphates;

(d) subjecting the conditioned slurry containing said frother and collector to a rougher flotation to produce a copper rougher concentrate and a lead tailing and cleaning said copper rougher concentrate in a cleaner flotation step to produce a copper concentrate; and (e) recovering lead from the tailing from the rougher froth flotation in step (d).

10. A process as set forth in claim 9 wherein the step (e) of recovering lead comprises the steps of:

(i) conditioning the tailing from the rougher froth flotation in step (d) with a lead collector and a frother and subjecting the conditioned tailing to a third flotation step to produce a lead rougher concentrate; and (ii) cleaning said lead rougher concentrate to produce a final lead concentrate.

11. A process as set forth in claim 9 wherein the step (e) of recovering lead comprises the steps of:

(i) conditioning the tailing from the rougher froth flotation in step (d) with a lead collector and a frother to produce a lead copper bulk rougher concentrate;

(ii) cleaning said lead copper bulk rougher concentrate to produce a bulk concentrate; and (iii) separating copper from the lead in the bulk concentrate.

12. A process as set forth in claim 9 wherein said pH in step (b) is between approximately 6.0 and 6.2.

13. A process as set forth in claim 9 wherein said source of bisulfite ion in step (b) is selected from the group consisting of sulfur dioxide, sulfurous acid and alkali metal salts of sulfites, bisulfites and or meta bisulfites.

14. A process as set forth in claim 9 wherein said source of bisulfite ion in step (b) is sulfur dioxide present in an amount between approximately 2 and 5 pounds per ton of ore.

15. A process as set forth in claim 9 wherein said causticized starch in step (b) is present in an amount between approximately 0.25 and 1.00 pound per ton of ore.

16. A process as set forth in claim 9 wherein said collector in step (c) is a blend of diisobutyl, diisoamyl and di n-pentyl dithiophosphates.

17. A process as set forth in claim 9 wherein said collector in step (c) is a blend of diisobutyl and diisoamyl dithiophosphates.

18. A process for selectively and sequentially recovering a copper concentrate, a zinc concentrate and a lead concentrate directly from an ore containing sulfides of copper, zinc and lead and being substantially free of water-soluble copper compounds which comprises the steps of:

(a) grinding a mixture of said ore and water to produce a slurry;

(b) conditioning said slurry with a combination of a source of bisulfite ion and causticized starch to depress zinc and lead and promote copper flotation, said conditioned slurry having a pH between approximately 6.0 and 6.5;

(c) adding to the conditioned slurry a frother and a copper collector selected from the group consisting of alkyl dithiophosphinates and dialkyl dithiophosphates;

(d) subjecting the conditioned slurry to a rougher froth flotation to produce a copper rougher concentrate and a tailing containing said lead and zinc and cleaning said copper rougher concentrate to produce a copper concentrate;

(e) treating the tailing from the rougher froth flotation in step (d) with a zinc activator, a zinc collector and a frother and subjecting the treated tailing to froth flotation to produce a zinc rougher concentrate and a lead tailing and cleaning said zinc rougher concentrate to produce a zinc concentrate:

(f) conditioning the lead tailing from the froth flotation in step (e) with a lead collector and a frother and subjecting the conditioned lead tailing to froth flotation to produce a lead rougher concentrate; and (g) cleaning said lead rougher concentrate to produce a final lead concentrate.

19. A process as set forth in claim 18 wherein in step (a) zinc sulfate is added to said mixture to depress zinc.

20. A process as set forth in claim 18 wherein said pH in step (b) is between 6.2 and 6.3.

21. A process as set forth in claim 18 wherein said source of bisulfite ion in step (b) is selected from the group consisting of sulfur dioxide, sulfurous acid and alkali metal salts of sulfites, bisulfites or meta bisulfites.

22. A process as set forth in claim 18 wherein said source of bisulfite ion in step (b) is sulfur dioxide present in an amount between approximately 2 and 5 pounds per ton of ore.

23. A process as set forth in claim 18 wherein said causticized starch in step (b) is present in an amount between approximately 0.25 and 1.00 pound per ton of ore.

24. A process as set forth in claim 18 wherein said collector in step (c) is a blend of diisobutyl, diisoamyl and di n-pentyl dithiophosphates.

25. A process as set forth in claim 18 wherein said collector in step (c) is a blend of diisobutyl and diisoamyl dithiophosphates.

26. A process as set forth in claim 18 wherein said zinc activator in step (e) is copper sulfate.

* * * * *